United States Patent [19]

Slinkard

[11] Patent Number: 4,773,709

[45] Date of Patent: Sep. 27, 1988

[54] SWIVEL SEAT AND INSULATED COOLER COMBINATION

[76] Inventor: Ronald L. Slinkard, 819 S. New, Pratt, Kans. 67124

[21] Appl. No.: 93,181

[22] Filed: Sep. 4, 1987

[51] Int. Cl.[4] ..... A47C 7/62

[52] U.S. Cl. ..... 297/193; 114/363; 297/183; 297/252

[58] Field of Search ..... 297/193, 192, 188, 217, 297/349, 252, 457; 62/371; 114/363, 194

[56] References Cited

U.S. PATENT DOCUMENTS

| | | | |
|---|---|---|---|
| 1,166,241 | 12/1915 | Moore | 248/131 |
| 2,747,654 | 5/1956 | Chapman et al. | 297/183 |
| 2,880,951 | 4/1959 | Springer | 248/131 |
| 3,113,804 | 12/1963 | Ritter | 297/252 |
| 3,114,574 | 12/1963 | Pryale | 297/193 |
| 3,560,047 | 2/1971 | Davis | 297/252 X |
| 3,718,365 | 2/1973 | Gibson | 114/363 |
| 3,839,757 | 10/1974 | Grimes | 297/192 X |
| 4,106,811 | 8/1978 | Hernandez | 297/193 |
| 4,184,281 | 1/1980 | Corby et al. | 297/192 X |
| 4,387,927 | 1/1983 | Fahey | 297/463 |
| 4,398,766 | 8/1983 | Everett | 114/363 X |
| 4,432,525 | 2/1984 | Duvall | 114/363 |

*Primary Examiner*—James T. McCall

*Attorney, Agent, or Firm*—Kokjer, Kircher, Bradley, Wharton, Bowman & Johnson

[57] ABSTRACT

A boat seat which also functions as an insulated container and a framework for mounting same in a boat are the subject of the present invention. The boat seat/insulated container combination comprises a generally cylindrical insulated sidewall with a top on which a person will be seated and a bottom which fits into a mounting receptacle. A portion of the sidewall is extended above the top to form a back for the seat and contains an opening near its top edge to provide a handle for carrying the seat. The mounting arrangement comprises a central set of parallel tubular members onto which is pivotally mounted a base plate and receptacle for receiving the seat. Telescopically attached to each end of the central mounting unit is a set of L-shaped parallel tubular members, the two sets being adjustable with each other to fit the width of the bottom of the boat. Telescopically attached to each L-shaped member is a set of U-shaped parallel tubular members, the fitting of which is adjustable to fit the height of the sidewall of the boat. An alternative embodiment provides a mounting arrangement adapted to fit a box type boat seat. The alternative mounting comprises a central set of parallel tubular members similar to those of the preferred embodiment. Telescopically attached to each end of the central members is a set of L-shaped parallel tubular members. The horizontal legs of the L-shaped members are adjusted with the central members to fit the width of the box type boat seat. The vertical legs of the L-shaped members extend downwardly and fit tightly against the sides of the boat seat by means of bolt and pressure plate assemblies. Thus, a pivotal boat seat/insulated container is provided which can be adapted to fit varying sizes and styles of boats, either without seats or with box type seats.

2 Claims, 2 Drawing Sheets

SWIVEL SEAT AND INSULATED COOLER COMBINATION

This invention relates generally to seats and, more particularly, to a boat seat which also functions as an insulated container as well as to a framework for mounting a pivotal seat in a boat.

Insulated containers are widely used by sportsmen for keeping food and drink cold and also for keeping fish and other game from spoiling. It is also known to employ pivotal seats in boats for the convenience of fishermen sitting in the boat. The best fishing boats are those commonly referred to as bassboats or johnboats which are relatively small in size and highly maneuverable. Because of the size of most fishing boats, space is at a premium. While there have been other attempts to make insulated coolers into seats, these attempts have generally been unsuccessful because of an absence of a back on the seat and no means for securing the seat inside of a boat.

It is, therefore, a primary object of the present invention to provide a combination seat and insulated cooler wherein the cooler includes an integral sidewall which projects above the top of the cooler to form a seat back.

As a corollary to the above object, an important aim of the invention is to provide a combination cooler and seat wherein the back includes a handle for carrying the cooler.

Another one of the objectives of the invention is to provide a framework for mounting a seat in a boat which framework includes telescoping sections for varying the width and height of the mounting platform and a pivotal platform base for holding the seat.

As a corollary to the foregoing object, it is an aim of the invention to provide a framework for mounting a seat in a boat which includes a pivotal platform means having a receptacle for receiving an insulated boat seat container.

As another corollary to the object second above, an important aim of the invention is to provide a framework for mounting a seat in a boat which in one embodiment is particularly designed for mounting on top of a box type seat which is integral with the boat and in another embodiment is designed to be supported from the gunwales of the boat.

Another one of the objects of this invention is to provide a pivotal seat in the form of an insulated container which has a removable top for keeping food or other items in the cooler, an integral sidewall which projects above the top to form a seat back and a pivotal base.

Another one of the important objects of the invention is to provide a pivotal seat and insulated container combination wherein the pivotal base for supporting the seat includes a receptacle in which the seat may be placed and firmly held without the need for auxiliary straps or other types of retaining members.

An important aim of the invention is to provide a pivotal boat seat and cooler of the type described wherein the mounting framework can accommodate different width boats and, in the case of the framework supporting the seat from the gunwales, can also be adjusted to different vertical heights.

Other objects of the invention will be made clear or become apparent from the following description and drawings where:

Figure 1:
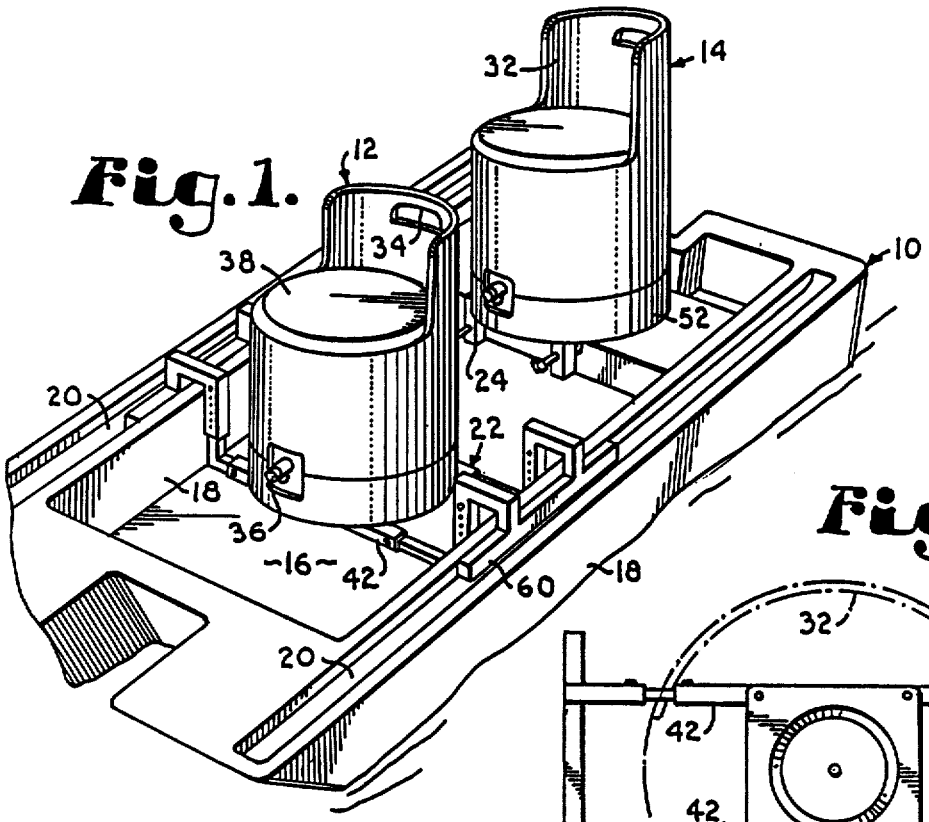
FIG. 1 is a perspective view of the combination boat seat and insulated container supported in one of two different ways on the inside of a boat which is represented schematically.

Referring initially to FIG. 1 of the drawing, a boat is represented schematically by the numeral 10 and a combination container and boat seat at the bow of the boat is designated generally by the numeral 12 while a second seat/container combination toward the stern of the boat is designated by the numeral 14. Boat 10 has a bottom 16 and sides 18 which terminate in gunwales 20.

Both of pivotal seats 12 and 14 are identical except for their supporting frameworks. The framework underneath seat 12 is designated generally by the numeral 22 while the framework under the seat 14 is designated generally by the numeral 24.

Figure 3:
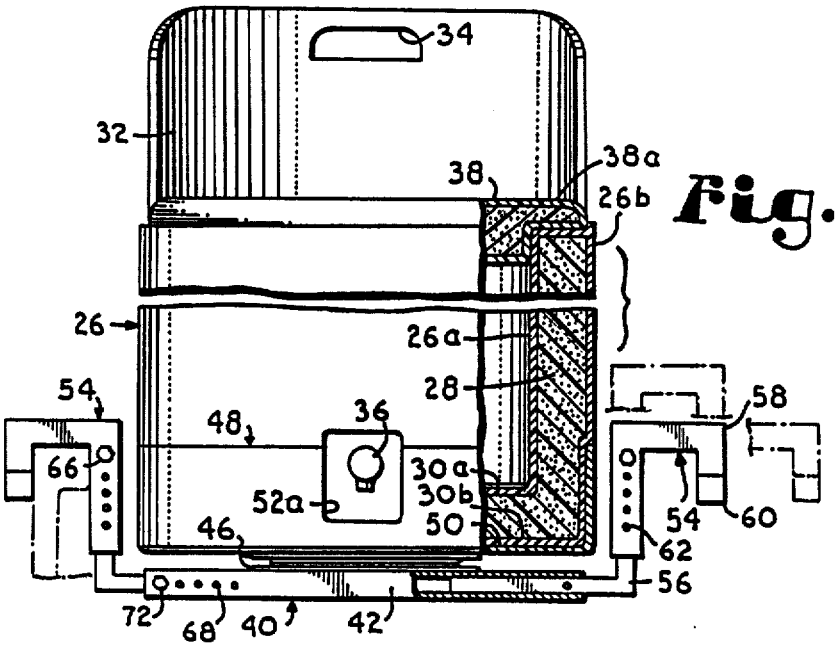
FIG. 3 is a front elevational view of the supporting framework and combination seat and cooler with portions broken away and shown in cross section for purposes of illustration.
Figure 4:
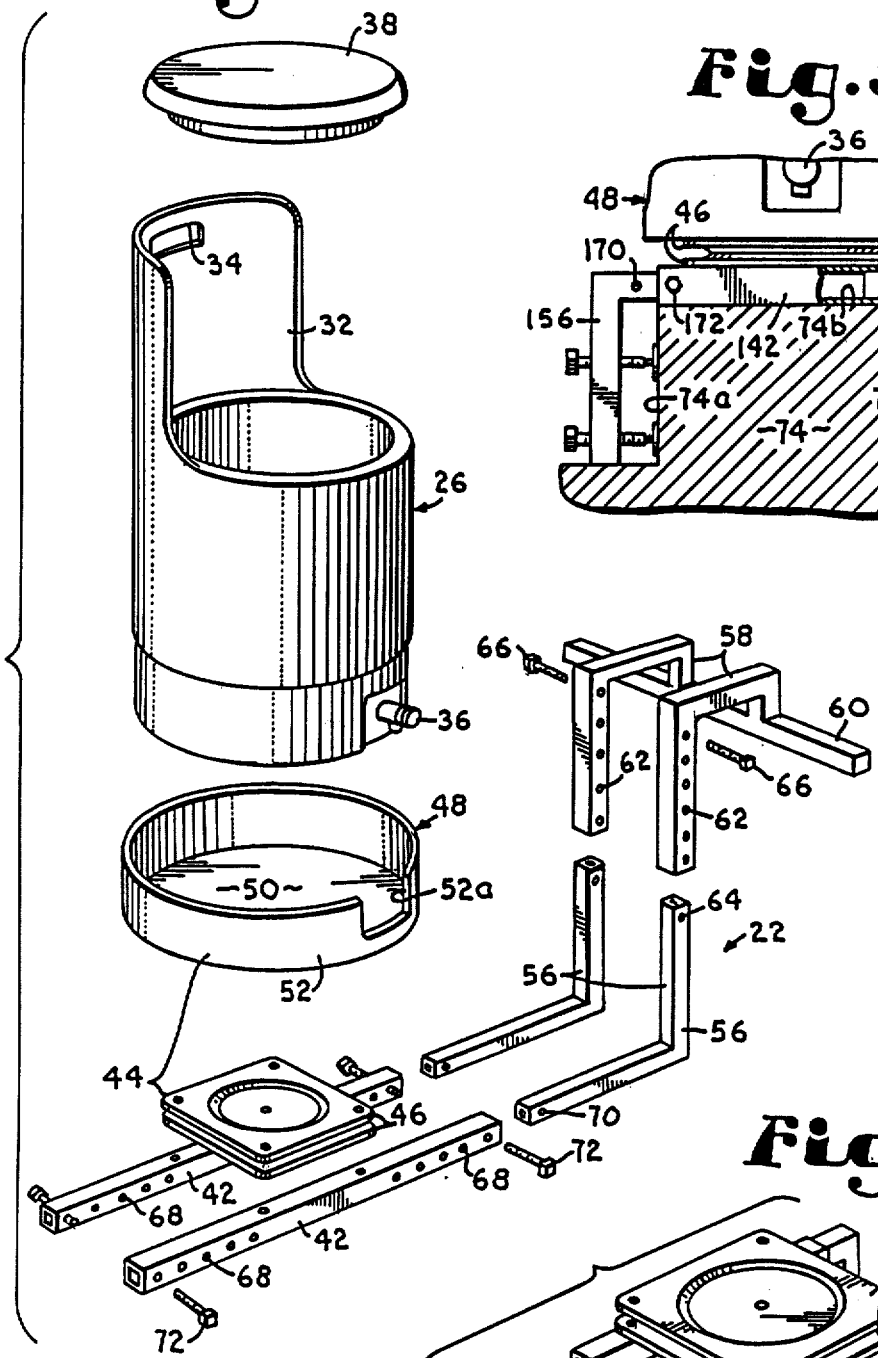
FIG. 4 is an exploded perspective view of the framework including the pivotal base and the combination container and seat according to the present invention.

Referring now to FIGS. 3 and 4, the combination insulated container and seat 12 comprises an insulated shell 26 formed by generally cylindrical inner and outer sidewalls **26*a* and 26*b*, respectively, having a layer of foam insulation 28 sandwiched therebetween. A generally planar bottom is presented by bottom surfaces 30*a* and 30*b* which are integral extensions of sidewalls 26*a* and 26*b*, respectively. Although not shown, it is to be understood that foam insulation 28 will also extend to the area between bottom surfaces 30*a* and 30*b*. As best illustrated in FIG. 4, an integral sidewall extension 32 projects upwardly from the top of shell 26 to form a seat back as will be explained more fully hereinafter. An opening 34** in the sidewall extension presents a handle for carrying the seat.

Shell 26 is also provided with a spigot and valve assembly 36 near the bottom for draining liquid from the inside of the container. Top 38 is also of double walled sandwiched foam construction so as to provide an insulated lid for the container formed by shell 26. Top 38 is provided with a peripheral edge **38*a* which overlies the top edge of the insulated shell 26 so as to assure a tight fit of the top and preclude lateral movement. Manifestly, the upper flat surface of top 38 is that on which a person will be seated when using the seat 12**.

Figure 2:
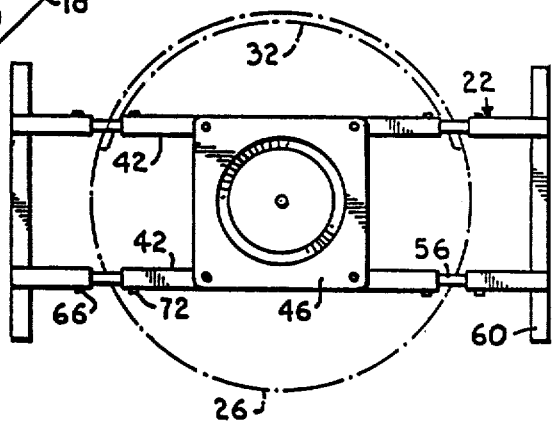
FIG. 2 is a top plan view of the framework for supporting the pivotal chair and cooler combination from the gunwales of a boat.

Referring to FIGS. 2–4, the supporting framework 22 of pivotal seat 12 includes a first section 40 comprising parallel tubular members 42 presenting flat top surfaces for mounting a support platform designated generally by the numeral 44. Platform 44 includes parallel base plates 46, the lower of which is secured to tubular members 42 and the upper of which is pivotally mounted on the lower plate through appropriate ball bearings, a bushing or the like. Rigidly secured to the upper base plate is a container receptacle designated generally by the numeral 48 and comprising a flat bottom 50 having a perimeter wall 52 extending upwardly therefrom.

Receptacle 48 is sized to snugly receive the bottom of shell 26 and has a cutaway portion 52*a* for accommodating spigot assembly 36.

Framework 22 also includes second and third sections 54 which are identical in construction and hence only one of which will be described in detail. Telescoping section 54 includes two parallel L-shaped tubular members 56 which present a portion of section 54 that is telescopically received by tubular members 42. A second portion of telescoping section 54 comprises first and second U-shaped tubular members 58 which are joined together at one end by an elongated linear siderail 60. A plurality of apertures 62 in one leg of U-shaped member 58 are positioned for alignment with one or more apertures 64 in one leg of each L-shaped member 56. When apertures in the respective members 56 and 58 are aligned, nut and bolt assemblies 66 are placed through the aligned apertures to hold the members in rigid relationship. Similarly, a plurality of apertures 68 in each end of each of members 42 are positioned for alignment with one or more apertures 70 in one leg of each member 56. When apertures 68 and 70 are aligned, nut and bolt assemblies 72 are provided for placement through the aligned openings so as to hold the members in rigid relationship.

In actual use of the seat 12, top 38 is removed and the container is partially filled with an iced drink which is dispensed through spigot assembly 36. The upper portion of the container may be used to keep food items cold and it is to be understood that, to accomplish this, it is often the practice to provide for a built in shelf or basket in the upper portion of the container so as to keep the food items out of the iced drink. Top 38 is then placed back on the container in the manner illustrated in FIG. 3 and handle 34 is grasped to provide a convenient means of carrying the loaded container to a location such as boat 10. Before the container is placed on its supporting framework, tubular members 42 are moved relative to the legs of tubular members 56 so as to adjust the framework to the width of the particular boat 10. Similarly, the height of the framework is adjusted by moving tubular members 58 relative to the upper legs of tubular members 56. Nut and bolt assemblies are placed through aligned apertures in the manner previously described to hold the various telescoping sections in rigid relationship. U-shaped members 58 are placed on the gunwales of boat 10 in the manner illustrated in FIG. 1. The siderails 60 engage the sides of boat 10 to preclude lateral movement of the framework. Shell 26 is then placed inside of receptacle 48 in the manner illustrated in FIG. 1. The seat 12 is now ready for use and a person can occupy the seat in the boat and can readily turn the seat 360° which is particularly advantageous when fishing from the boat. Sidewall extension 32 provides a back support which increases the comfort of the person utilizing the seat. It is to be understood that the height of sidewall extension 32 may be varied to accommodate the needs and comfort of different users. The particular height of sidewall extension 32 shown in the drawings is intended only to illustrate the principal of an integral chair back formed by the sidewall extension.

When it is desired to obtain a drink from the container, spigot 36 is activated and a cup or other drinking utensil is placed beneath the spigot without the need to open top 38 or leave the seat. When food or other items are to be withdrawn from the inside of the container, the person utilizing the seat may stand briefly to remove the top 38 and take the desired food items from inside of the container after which the top is replaced.

Manifestly, when the seat 12 is to be utilized with different sized boats, framework 22 can be varied in both height and width by moving the telescoping sections so as to accommodate the different size vessel. It is within the scope of the invention to provide a container 12 which does not employ framework 22 and instead the shell 26 may be placed on the ground or other supporting surface for viewing sporting events, for picnicking or other leisure activities.

Figure 5:
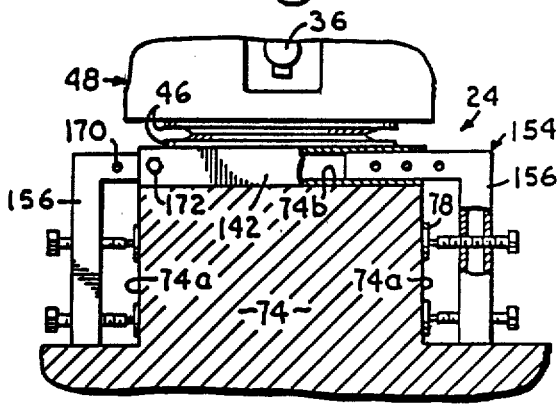
FIG. 5 is an end elevational view of an alternative embodiment of the invention particularly adapted for mounting on a box type boat seat.
Figure 6:
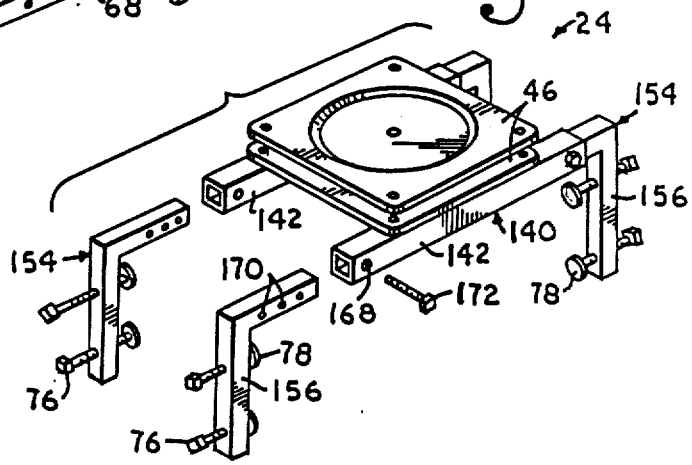
FIG. 6 is a perspective view of the alternative mounting framework shown in FIG. 5.

Referring now to the alternative embodiment of the invention represented by seat 14, this seat differs from the seat of the preferred embodiment above-described only with regard to the supporting framework 24 which is best illustrated in FIGS. 5 and 6. Referring to these figures, boat 10 is provided with a integrally formed box type seat 74 which has sides 74*a* and a top 74*b*. Framework 24 includes a first section 140 of elongated tubular members 142 which receive the base plates 46 of a support platform 44 in the same manner as described above for the preferred embodiment. Second and third telescoping frame sections 154 are identical and hence only one will be described. Each frame section 154 comprises two L-shaped tubular members 156, one leg of which is generally vertically disposed, the other leg being substantially horizontally disposed. Bolts 76 which extend through openings in the vertical leg of L-shaped member 156 are provided with pressure plates 78 secured to the ends of the bolts. Each horizontal leg of member 156 is provided with a plurality of apertures 170 which are positioned for alignment with one or more apertures 168 in tubular members 142. A plurality of nut and bolt assemblies 172 are adapted to be placed through aligned openings 168 and 170 to hold elements 142 and 156 in rigid relationship.

The seat 14 is used in the same manner as the seat 12 previously described except that framework 24 is positioned over box seat 74 and the width thereof adjusted until the legs of sections 154 are in slightly spaced relationship to the sidewall 74*a* of the box type seat. Bolts 76 are then tightened to bring pressure plates 78 into engagement with the sides 74*a*. The flat surface of frame section 140 which is opposite the surface that mounts support platform 44 rests on the top 74*b* of box seat 74 to provide support for shell 26. Shell 26 is placed in receptacle 48 in the same manner as previously described. By virtue of the telescoping sections of framework 24, the width of the framework can be readily adjusted so as to accommodate different size box seats in different types and styles of boats.

I claim:

1. A pivotal seat comprising:

a container having an insulating shell, a flat bottom surface, a sidewall, a top surface and a back support projecting upwardly from said sidewall and above said top surface;

a generally horizontal pivotally mounted base plate;

a receptacle coupled with said base plate and including a bottom and a perimeter wall rising from said bottom for receiving said container and holding same against lateral movement; and adapted to receive said container;

means for supporting said base plate on a boat comprising first, second, and third telescoping sections and means for holding said sections in rigid relationship whereby the width and height of said supporting means is variable, said second and third sections being adapted to be supported by the sides of said boat, and means for engaging said boat sides to preclude lateral movement of said supporting means.

2. A pivotal seat comprising:

a container having an insulated shell, a flat bottom surface, a sidewall, a top surface and a back support projecting upwardly from said sidewall and above said top surface;

a generally horizontal pivotally mounted plate;

a receptacle coupled with said base plate and including a bottom and a perimeter wall rising from said bottom for receiving said container and holding same against lateral movement; and means for supporting said base plate on a boat comprising first, second and third telescoping sections and means for holding said sections in rigid relationship whereby the width of said supporting means is variable, said second and third sections including means for gripping the sides of a box type boat seat.

* * * * *